US007478447B2

(12) United States Patent
Wilming et al.

(10) Patent No.: US 7,478,447 B2
(45) Date of Patent: Jan. 20, 2009

(54) ADJUSTING DEVICE AND ADJUSTABLE SUPPORT DEVICE FOR BEDS, MATTRESSES, ARMCHAIRS AND THE LIKE

(75) Inventors: Michael Wilming, Krefeld (DE); Rolf Farmont, Dusseldorf (DE); Johannes Schneider, Kirchlengern (DE)

(73) Assignee: Cimosys AG, Goldingen (CH)

( * ) Notice: Subject to any disclaimer, the term of this patent is extended or adjusted under 35 U.S.C. 154(b) by 395 days.

(21) Appl. No.: 10/520,483

(22) PCT Filed: Jul. 10, 2003

(86) PCT No.: PCT/EP03/07460

§ 371 (c)(1),
(2), (4) Date: Oct. 3, 2005

(87) PCT Pub. No.: WO2004/006725

PCT Pub. Date: Jan. 22, 2004

(65) Prior Publication Data

US 2006/0143827 A1 Jul. 6, 2006

(30) Foreign Application Priority Data

| | | |
|---|---|---|
| Jul. 10, 2002 | (DE) | 102 31 290 |
| Nov. 15, 2002 | (DE) | 202 17 698 U |
| Nov. 15, 2002 | (DE) | 202 17 726 U |
| Nov. 15, 2002 | (DE) | 202 17 759 U |
| Feb. 26, 2003 | (DE) | 203 03 201 U |

(51) Int. Cl.
*A61G 7/015* (2006.01)

(52) U.S. Cl. ..... 5/618

(58) Field of Classification Search ..... 5/618, 5/617, 613, 616

See application file for complete search history.

(56) References Cited

U.S. PATENT DOCUMENTS

| | | | |
|---|---|---|---|
| 6,742,205 | B2 | 6/2004 | Dewert |
| 6,754,922 | B2 | 6/2004 | Dewert |

(Continued)

FOREIGN PATENT DOCUMENTS

| | | |
|---|---|---|
| CH | 607682 | 10/1978 |

(Continued)

OTHER PUBLICATIONS

PCT Form 210 (International Search Report dated Oct. 27, 2003).

(Continued)

*Primary Examiner*—Alexander Grosz
(74) *Attorney, Agent, or Firm*—Fay Sharpe LLP

(57) ABSTRACT

The invention relates to an adjusting device (10) for beds, mattresses, armchairs and the like, which comprises support elements (12) that extend at an angle to the adjusting direction (A), especially on both sides, and that form together a plane of support (12A), and at least one drive device (24) for modifying the inclination of the plane of support, said drive device comprising at least one pivotable raising lever (14). In order to provide an adjusting device that is simple in design, at least one pivotable raising lever (14) is combined with a plurality of bar members (16A-G) that can be pivoted relative one another so that the general raising movement is combined with the ergonomic detail movement.

46 Claims, 15 Drawing Sheets

U.S. PATENT DOCUMENTS

| | | | |
|---|---|---|---|
| 6,961,971 | B2 | 11/2005 | Schneider et al. |
| 2005/0120481 | A1 | 6/2005 | Farmont et al. |

FOREIGN PATENT DOCUMENTS

| | | | |
|---|---|---|---|
| CH | 679445 | | 2/1992 |
| DE | 9011742 | | 10/1990 |
| DE | 94 12 497.3 | | 10/1994 |
| DE | 29714746 | | 10/1997 |
| DE | 297 14 299 | | 12/1997 |
| DE | 197 18 057 | | 5/1998 |
| DE | 298 02 465 | | 6/1998 |
| DE | 100 46 751 | | 7/2001 |
| DE | 199 62 537 | | 7/2001 |
| DE | 100 179 78 | | 10/2001 |
| DE | 199 62 541 | | 2/2002 |
| DE | 100 179 79 | | 4/2002 |
| DE | 100 317 37 | | 5/2003 |
| DE | 102 31 290 | B3 | 1/2004 |
| EP | 0761137 | | 3/1997 |
| EP | 1183966 | | 3/2002 |
| EP | 1266597 | | 12/2002 |
| EP | 1 523 257 | B1 | 6/2006 |
| GB | 2081083 | | 2/1982 |
| WO | WO 0126509 | | 4/2001 |

OTHER PUBLICATIONS

Opposition filed in European counterpart Patent EP 1 523 257.

A
16A
22
16B
26
A
16C
16D
16E 30A
20
20E
16G
18A
14'
18B
16F
16E 16G
16F
16E

ADJUSTING DEVICE AND ADJUSTABLE SUPPORT DEVICE FOR BEDS, MATTRESSES, ARMCHAIRS AND THE LIKE

BACKGROUND

The present disclosure pertains to an adjusting device for beds, mattresses, armchairs and the like, consisting of support elements or bar members extending at an angle to the adjusting direction and at least one drive device for modifying the inclination of the support plane, in which at least one pivotable raising lever is provided, or in which the bar members form a link chain. It additionally pertains to an adjustable support device for mattresses or cushions, beds, armchairs and the like consisting of pivotable bars with support elements extending between the bars, spanning a support plane.

Such adjusting devices are known, for instance, for holding mattresses of beds. A frame, or at least lateral bars, carries the support elements, which span the support plane of the mattress or the like. In addition to cloth supports, metal grids and the like, spring strips that form a so-called slat grating are especially often used. The adjusting device is intended to provide comfort and relaxation in the supine, seated or semi-supine position.

Using a motor-driven or manually pivotable raising lever is known, for instance, for modifying the inclination of hospital beds. As a rule, these levers are rigid. Most of these raising levers have the disadvantage that they are visible in the sitting or semi-supine position and are therefore visually disruptive. Safety risks also exist. Moreover, it is only possible with these levers to pivot two areas (head part and foot part), each straight within itself, about a center part. Whereas it is not possible to influence the shape of the lateral bars defining the support plane, i.e., to adapt them more to the back and posterior of a human being.

As an alternative solution, it has therefore been proposed to design the lateral bars as a link chain and pivot the links relative to one another. Such pivoting takes place by means of pressure or preferably by means of tension belts or pull rods. Such an adjusting device is extraordinarily complex, however, and consists of very many individual parts if one would like to achieve a semi-supine or sitting position starting from the extended supine position. This becomes particularly clear from WO 01/26509 A1. Such adjusting devices do indeed permit a very elegant external appearance of the finished product, because supporting, adjusting and drive elements are completely integrated into the bars or into a mattress or upholstery. However, in addition to the complex construction, it is disadvantageous in that the successive or simultaneous relative pivoting of various bar members can only be controlled relatively imprecisely. But it is desirable for the adjusting device to be able to assure an optimal support of the back, the posterior and, optionally, the legs in the various positions between the extended resting or supine position and the very upright sitting position, i.e., above all, to support the spinal column.

With this background, there is a need for an adjusting device of particularly simple construction. An additional objective is to design the mechanical structure of such an adjusting device robustly and nevertheless to permit an ergonomic multi-element adjustment. An additional need is to design the adjusting device robustly and yet elegantly, i.e., without externally projecting or protruding head part or back rests. Increased safety is also desirable. Finally, it would be desirable to specify exactly and decisively the mutual displacement of bar members in every general inclination between a supine and a sitting position of the user.

Since the forces weighing on the free foot end in case of a raised foot part are considerable, a foot part brace usually serves to intercept and direct these forces to a fixed substructure such as a bed frame. Such foot braces are generally simple connecting rods, pivotably seated at one end on the slat grating and on the support component, such as the bed frame, at the other. This arrangement for hospital beds, for example, makes the implementation of an elegant and inconspicuous design difficult and makes an exact match necessary between, for instance, the slat grating and a bed frame. It also hinders manually pivoting the foot part, which is unfavorable for practical use. Accordingly, there is a need for a simple and inconspicuous foot support for devices of this class that is uncomplicated to handle.

SUMMARY

An adjusting device for beds, mattresses, armchairs and the like is provided. More particularly, in accordance with this aspect, the adjusting device includes support elements extending at an angle to an adjusting direction, particularly, on both sides, jointly spanning a support plane an at least one drive device for modifying the inclination of the support plane with at least one pivotable raising lever, wherein the at least one pivotable raising lever is provided with several bar members that are separately pivotable differently by means of the pivotable raising lever.

According to another aspect, an adjusting device for beds, mattresses, armchairs and the like is provided. More particularly, in accordance with this aspect, the adjusting device includes bar members extending at an angle to an adjusting direction, particularly, on both sides, jointly spanning a support plane, with at least one drive device for modifying the inclination of the support plane, in which the bar members form a link chain, wherein the bar members jointly house, essentially completely, an inherently rigid, pivotable raising lever serving for mutual adjustment of the bar members.

According to yet another aspect, an adjustable support device for mattresses, or cushions, beds, armchairs and the like is provided. More particularly, in accordance with this aspect, the adjustable support device includes pivotable bars with support elements extending between the bars, spanning a support plane, wherein the pivotable bars are each formed of at least one inherently rigid raising lever, and in that the raising lever carries a link chain of support element bearing members (bar members) pivotable relative to one another.

An adjusting device, according to any of the aforementioned aspects, can lead to a robust, very simply constructed, visually appealing and specifically ergonomic overall solution.

According to still yet another aspect, an adjusting device where beds, mattresses, armchairs or the like is provided. More particularly, in accordance with this aspect, the adjusting device includes bar members extending at either side at an angle to an adjusting direction, jointly spanning a support plane formed of support elements, with at least one drive device for modifying the inclination of a support device, in which the bar members form a link chain, wherein one of the bar members comprises a driven extensible bracing element for bracing the bar member against a base surface.

In one embodiment, the driving of the extensible brace element is preferably performed simultaneously by the adjustment drive of the bar members, preferably by means of a raising lever driven to undergo a pivoting motion. A rocker bar integrated into the bar member in question represents a particularly simple drive transfer means for extending and retracting the brace element.

According to still yet another aspect, the adjusting device for beds, mattresses, armchairs or the like is provided. More particularly, in accordance with this aspect, bar members extend at either side at an angle to the adjusting direction, jointly spanning a support plane, with several drive devices for modifying the inclination of the support device, in which the bar members form a link chain, including at least a head part, a foot part and a middle part, wherein each of the two bar members defining the middle part houses as a drive unit a pair of electric motors such that output shafts extend essentially parallel to respective bar members and are arranged in a plane extending essentially through the bar members.

Such an adjusting device can allow electric drive motors of the drive unit of adjusting devices to be used more effectively while housing them inconspicuously.

This can have the effect, among other things, that the head or foot part of the adjusting device is synchronously raised or lowered on both bar sides, without torsion-induced twisting arising between the bar members of the head part and/or the foot part. Thus it is possible to make do with compact drive motors and simple gear assemblies, even for relatively wide beds, mattresses, armchairs and the like, and to dispense with expensive anti-torsion devices.

BRIEF DESCRIPTION OF THE DRAWINGS

Shown in the drawings are:

FIG. 7A, an additional alternative embodiment of an adjusting device for bed mattresses, armchairs and the like in a plan view in the non-adjusted rest state;

DETAILED DESCRIPTION

Figure 1A:
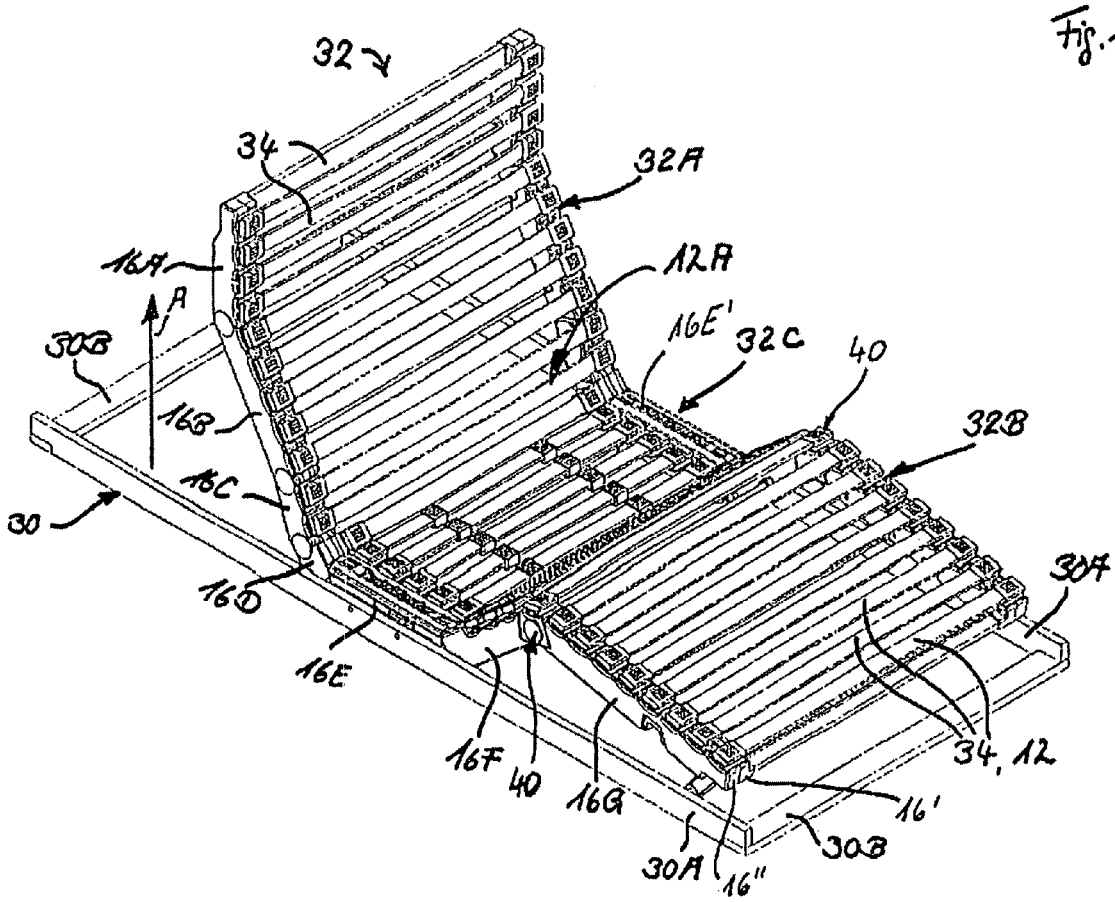
FIG. 1A, an adjustable slat grating for bed mattresses in raised position, in perspective.
Figure 1B:
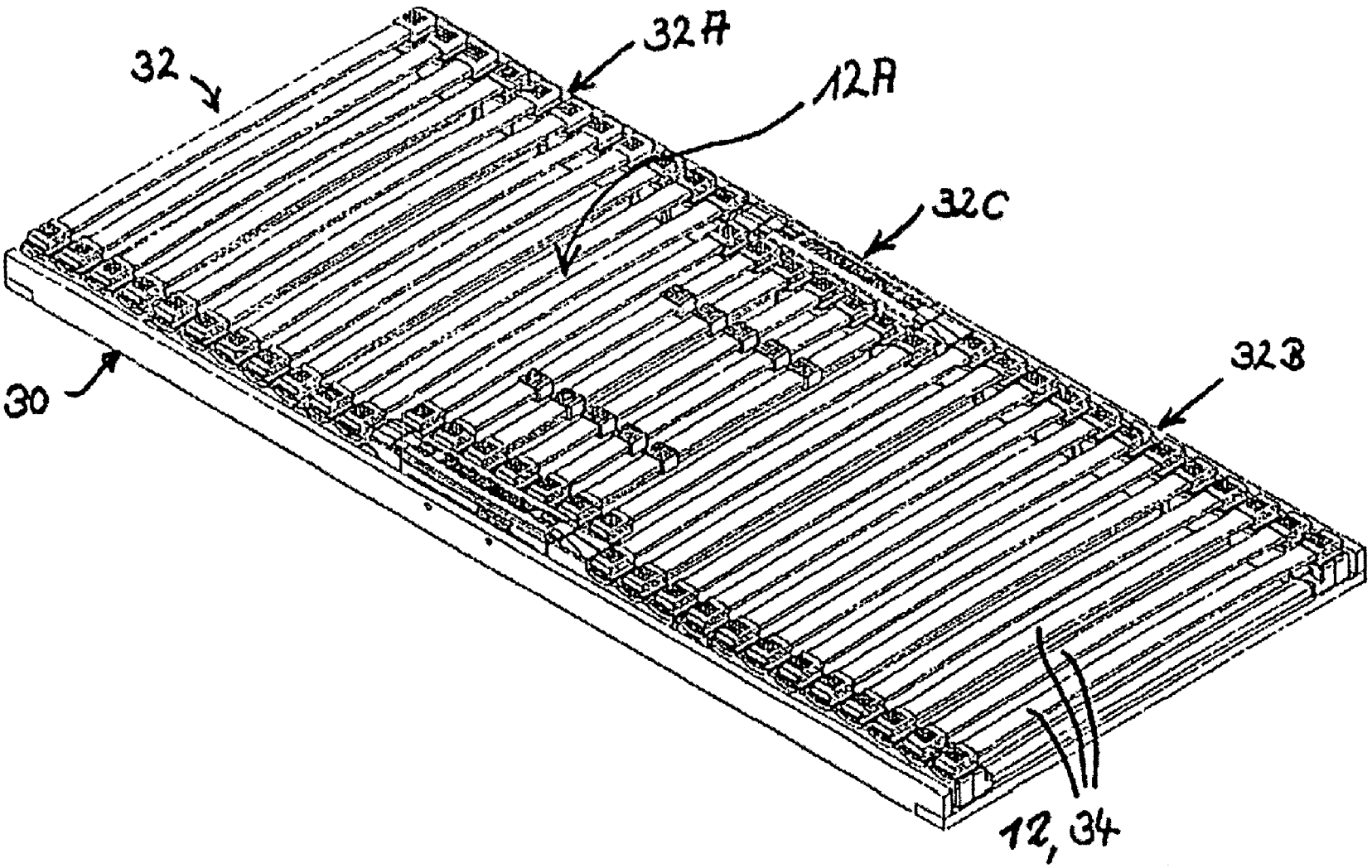
FIG. 1B, the same adjustable slat grating in a flat position, in perspective.

FIGS. 1A and 1B show a slat grating for bed mattresses. A rigid bed frame 30 includes parallel long beams 30A and parallel cross beams 30B made, for instance, of wood. An adjustable slat grating 32 is accommodated between long beams 30A, a multiply pivotable head part 32A and a multiply pivotable foot part 32B being articulated on the appropriate sides to a middle part 32C. Middle part 32C is joined to long beams 30A of rigid bed frame 30 permanently by means of, for example, screws. Slat grating 32 is generally formed of two articulated bars 16 on the parallel long edges, and spring strips or bows 34 connecting the bars 16. In the illustrated embodiment, the two bars 16 are composed of a total of seven bar members 16A-16G, which are pivotably joined together, as will be seen from the description below.

Figure 2:
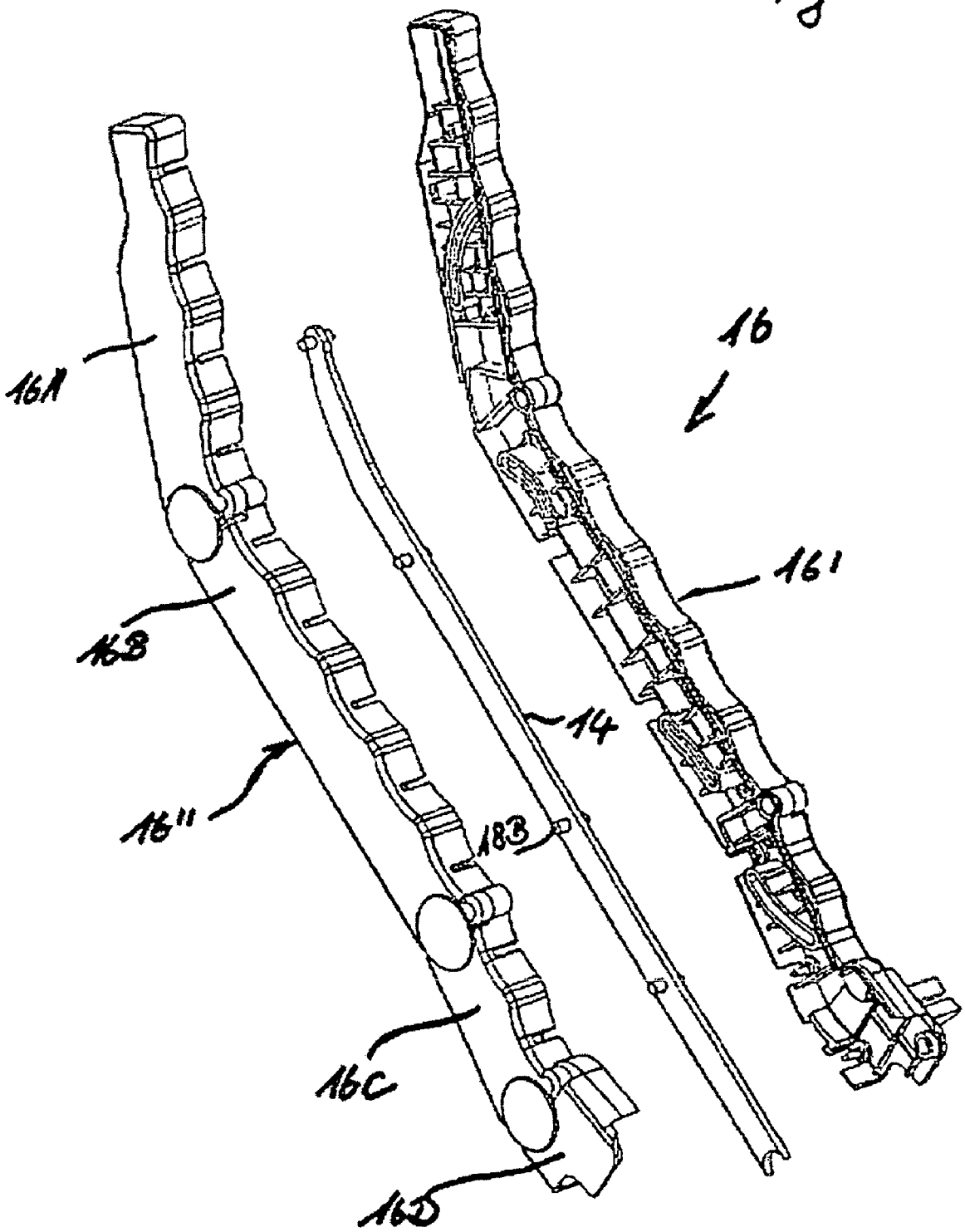
FIG. 2, from the same slat grating, one bar of the head area in an exploded view, in perspective.

FIG. 2 shows the head area of a bar 16. From the illustration, it is evident that the bar 16, i.e., each link in the bar, is divided longitudinally in the vertical plane and holds, in the manner of a casing, an inherently rigid raising lever 14 of length roughly equal to the head area of the bar and almost completely encloses it between inside bar part 16' and outside bar part 16". The casing-like bar 16, or the casing-like bar members 16A-16D comprise as integral components adjusting members 18A, which, during the pivoting up or lowering of head part 32A by pivoting raising lever 14, make it possible to pivot the individual bar members relative to one another and in the same or in a different rotational sense with respect to one another. This and other special features of the adjusting device according to the invention will be explained further on the basis of the second embodiment with FIGS. 3A-5D.

Figure 3A:
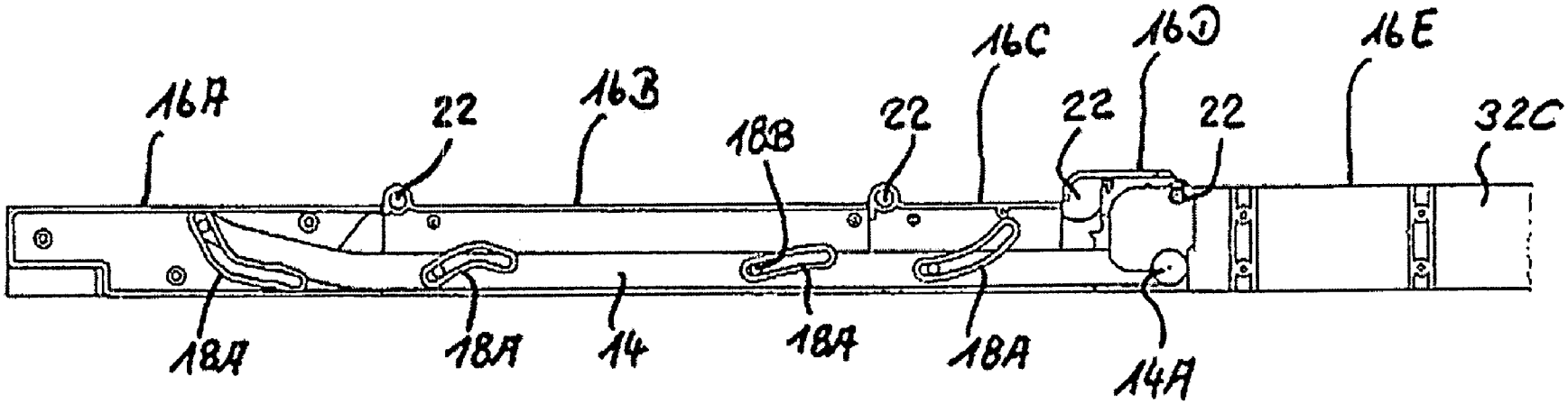
FIG. 3A, a simplified representation/embodiment of the bar according to FIG. 2 in a side view of the inside part of the bar, in the extended position.
Figure 3B:
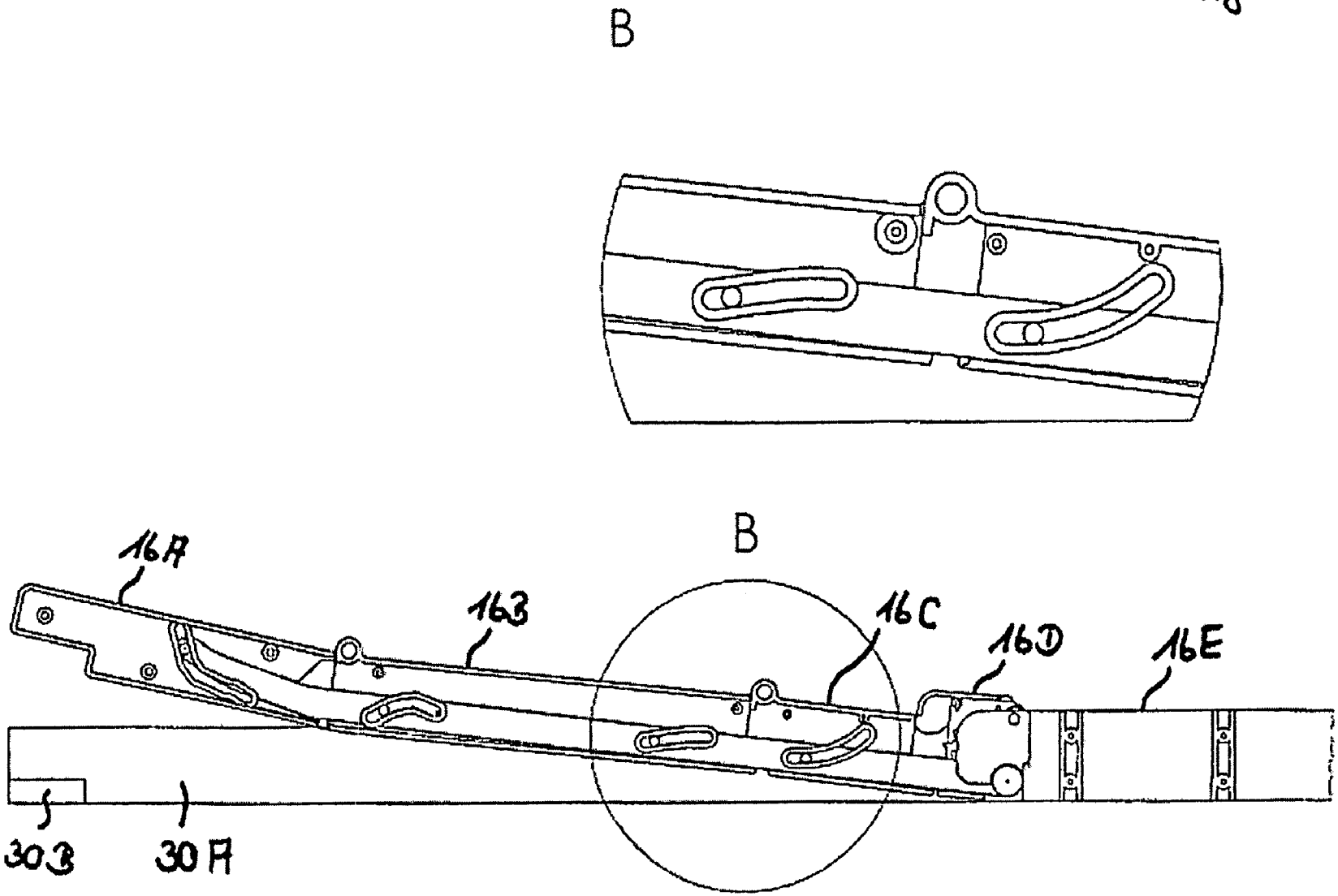
FIG. 3B, the same inside part of the bar in slightly raised position.
Figure 3C:
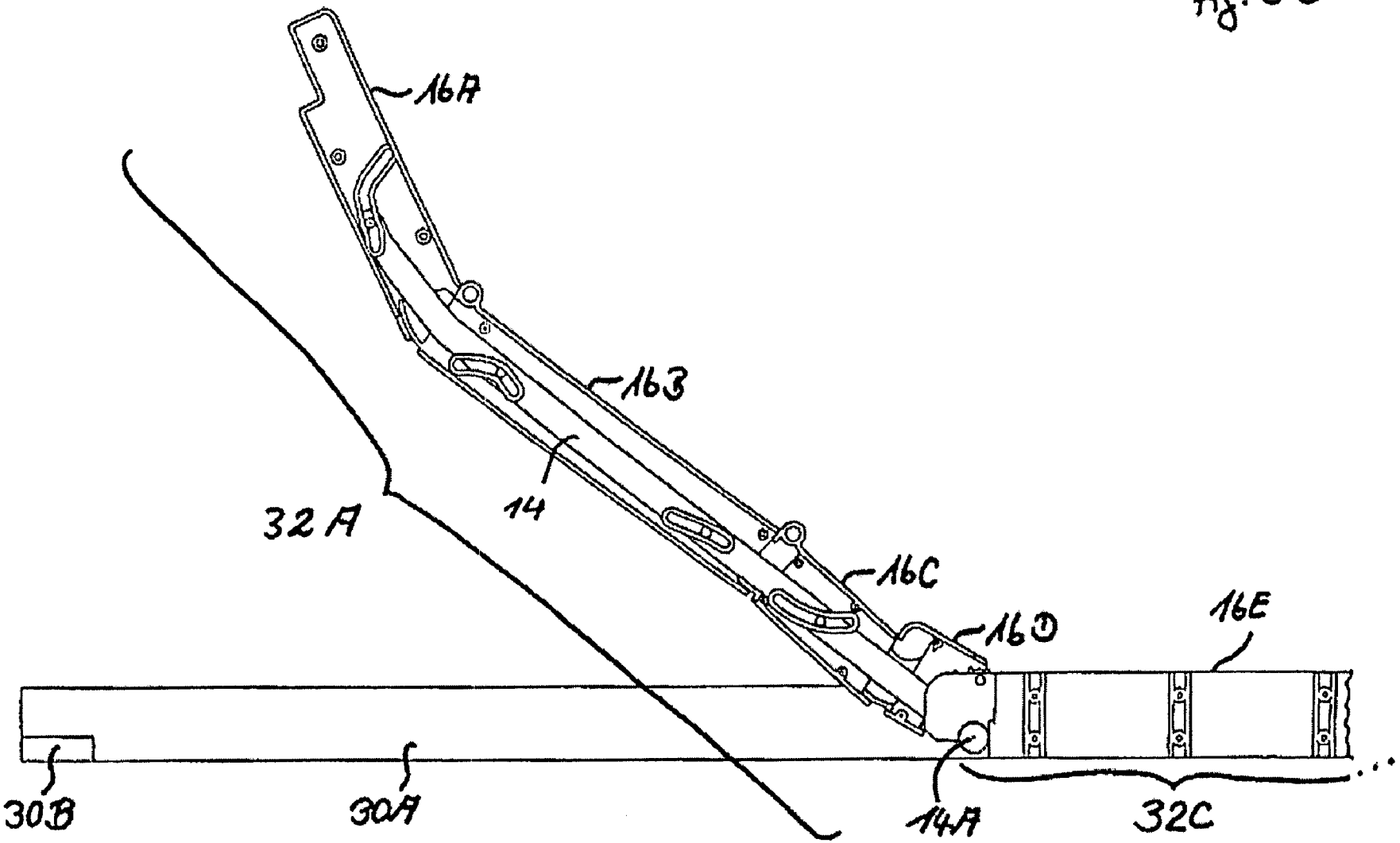
FIG. 3C, the same inside part of the bar in markedly raised position.
Figure 3D:
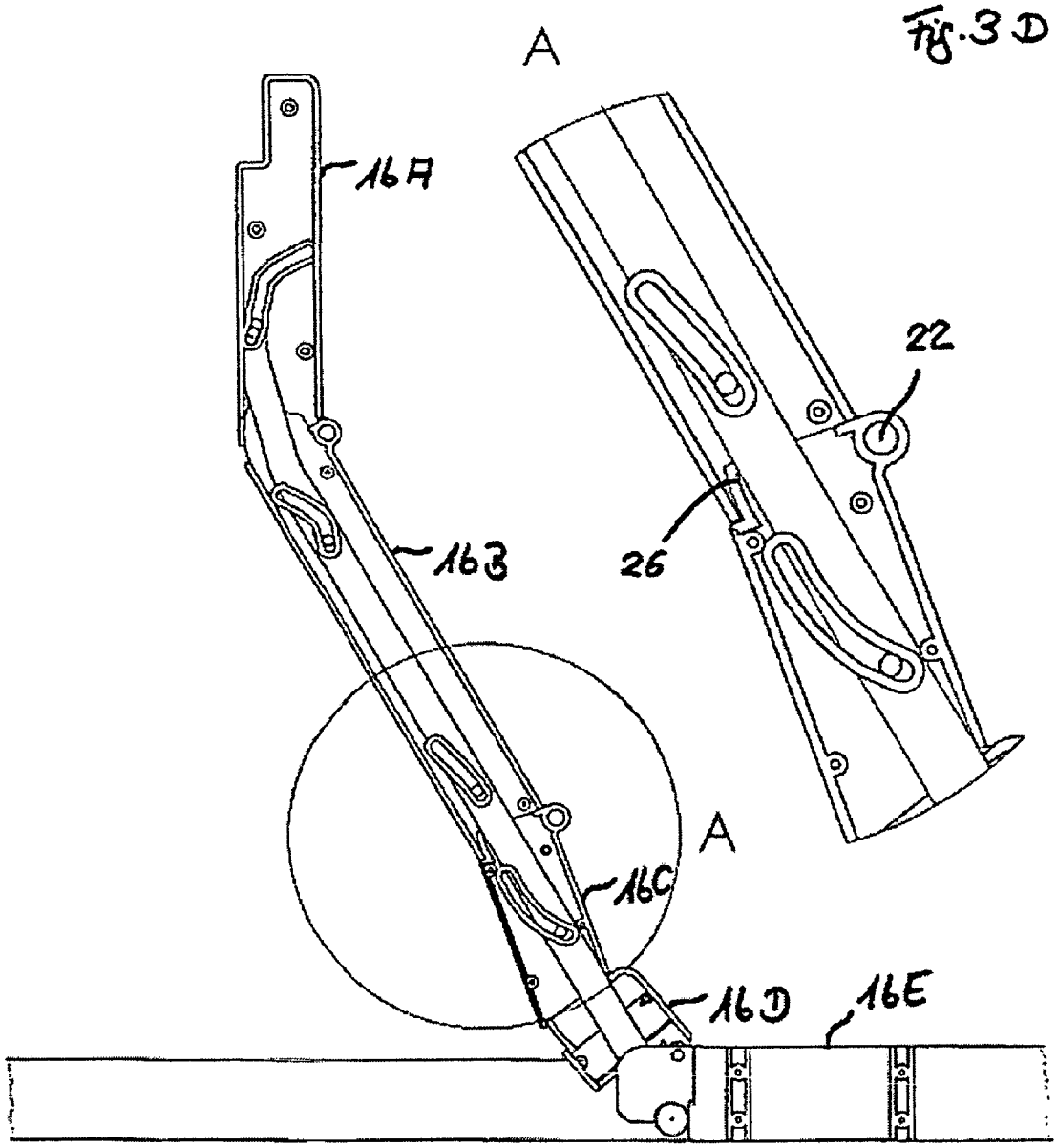
FIG. 3D, the same inside part of the bar in almost completely erect position.
Figure 4A:
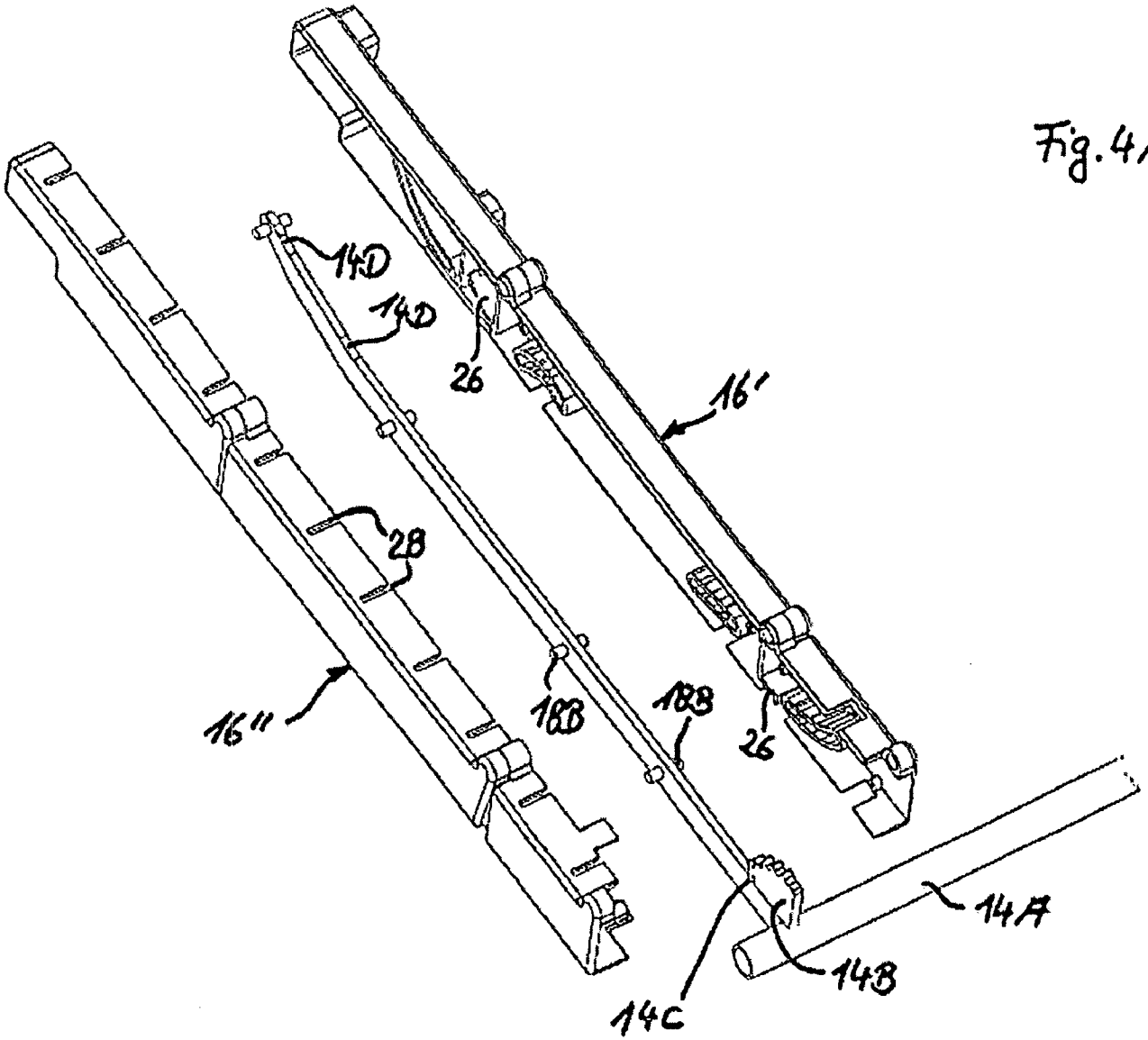
FIG. 4A, a perspectival exploded view (corresponding to FIG. 2) of the bars of FIGS. 3A-3D.
Figure 4B:
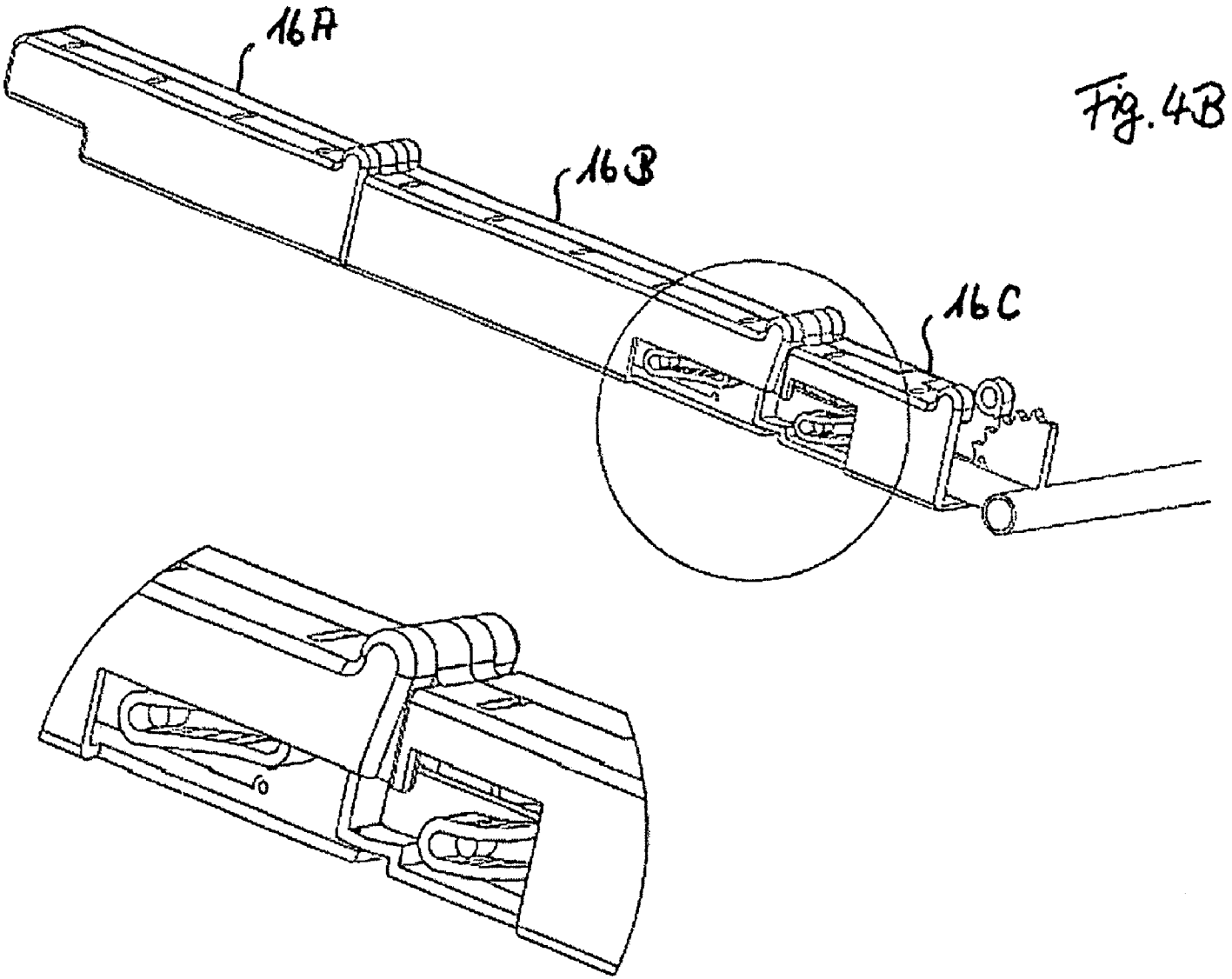
FIG. 4B, the same bar in the assembled state, partially cut away.
Figure 5A:
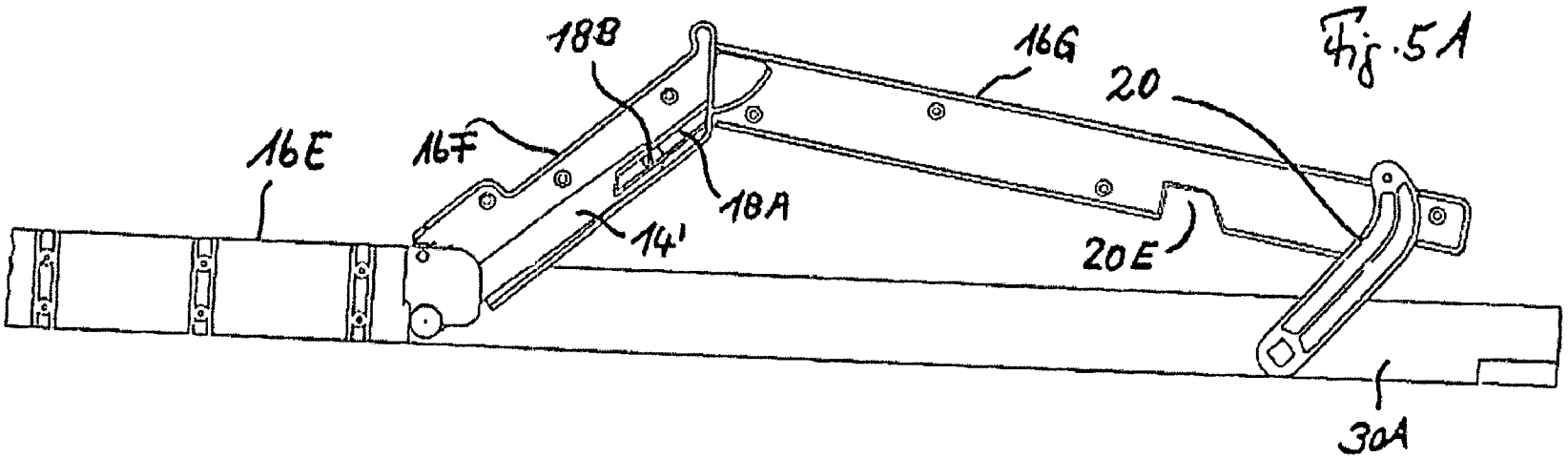
FIGS. 5A-5D, the foot area of the bar part according to FIGS. 3A-4B in a sequence of different raising stages.
Figure 5B:
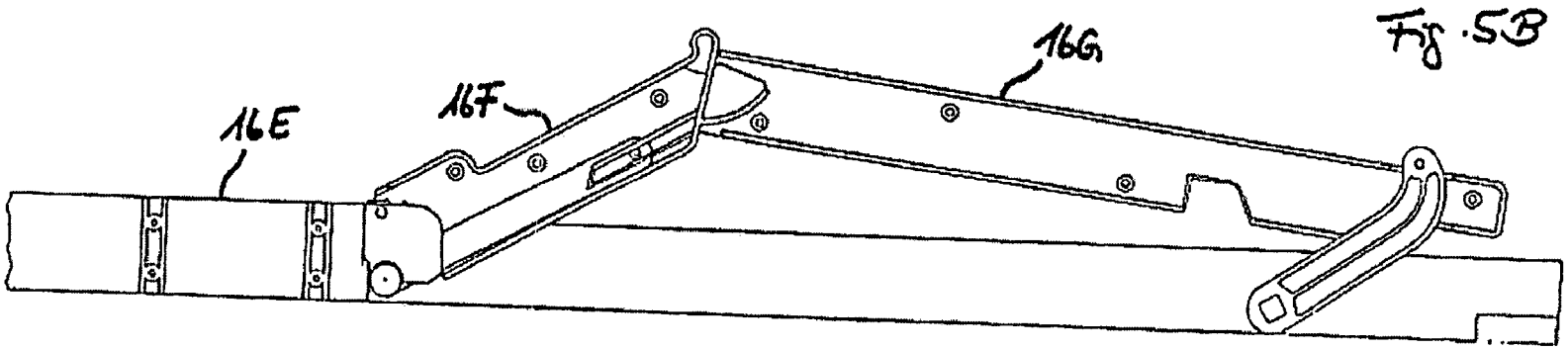
Figure 5C:
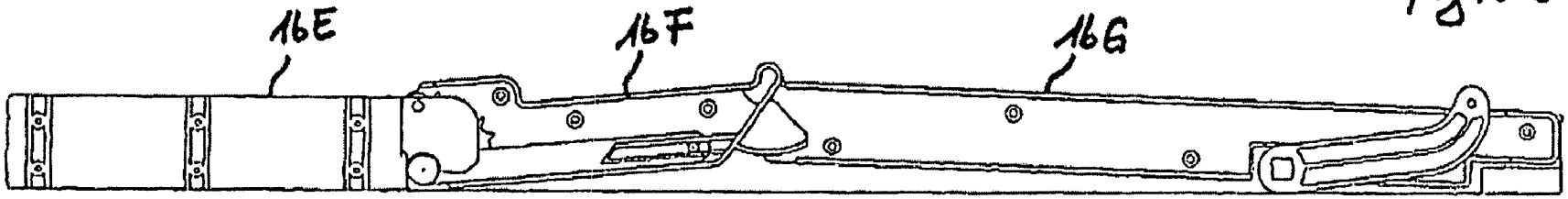
Figure 5D:
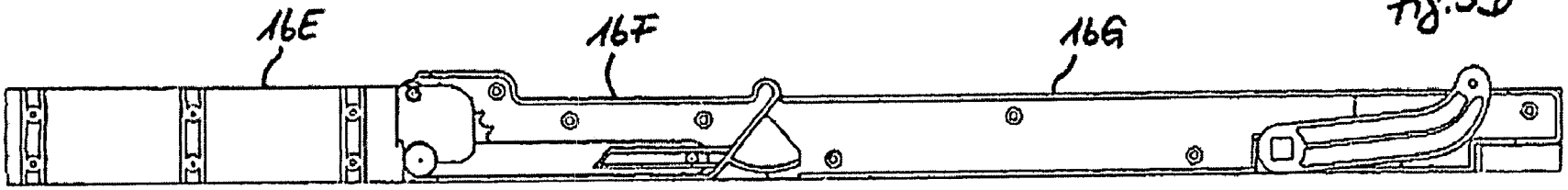
Figure 6A:
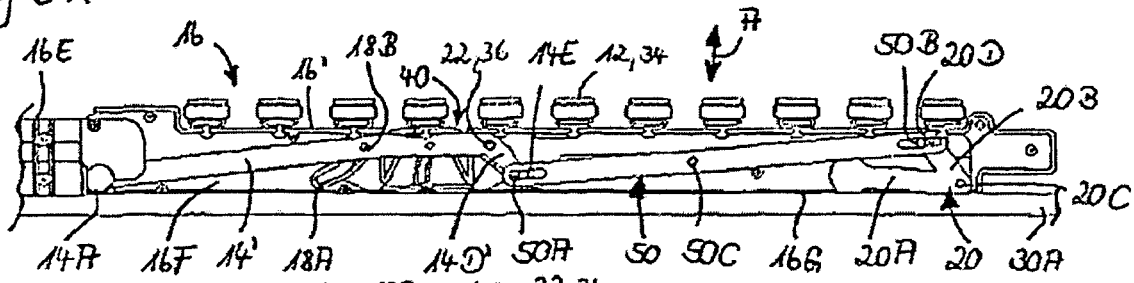
FIG. 6A, a side view of an alternative embodiment of an adjustable slat grating for bed mattresses, into the interior of the bar members forming the foot part, specifically, in the extended rest position of the adjustable slat grating.
Figure 6B:
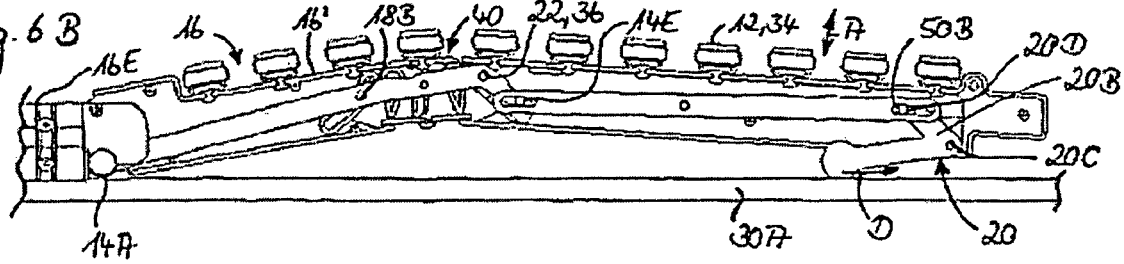
FIGS. 6B-6E, a sequence of the same detail in various adjustment positions of the slat grating.
Figure 6C:
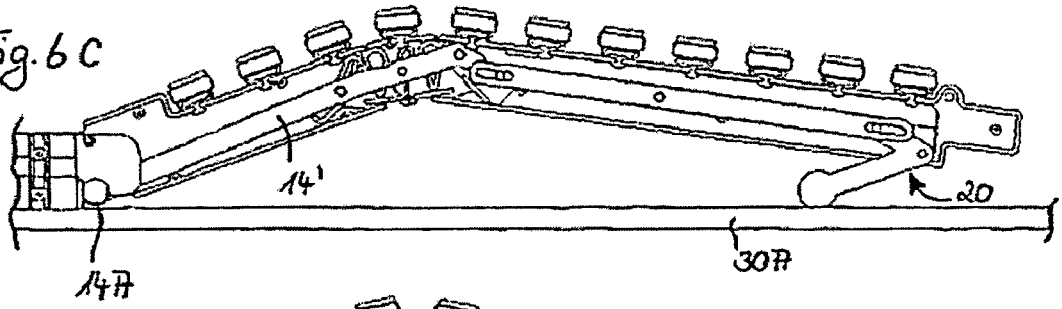
Figure 6D:
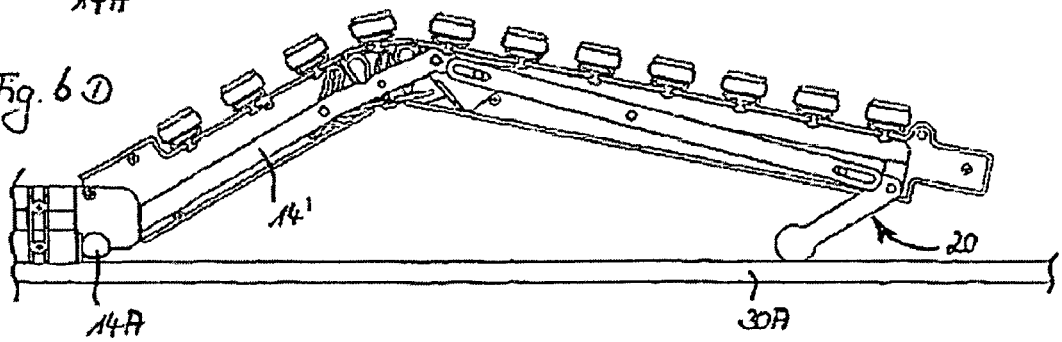
Figure 6E:
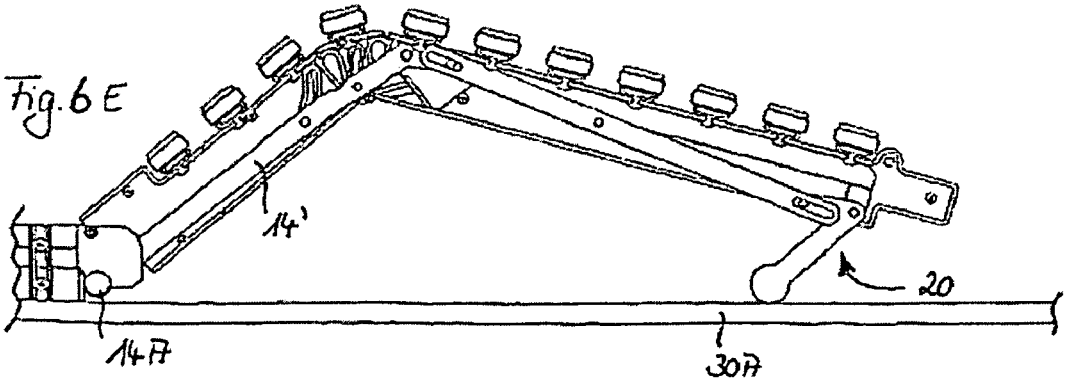
Figure 14:
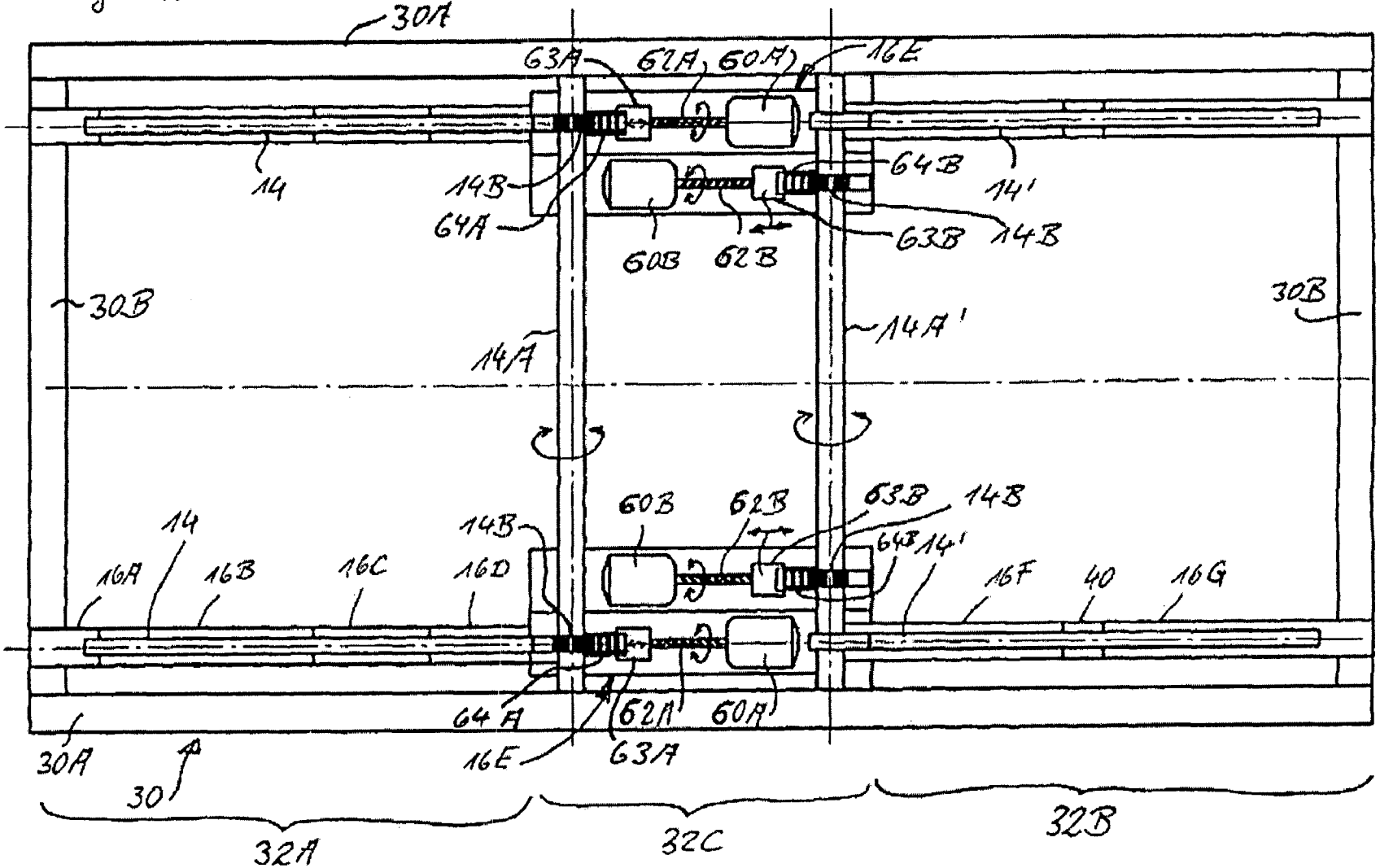
Figure 7B:
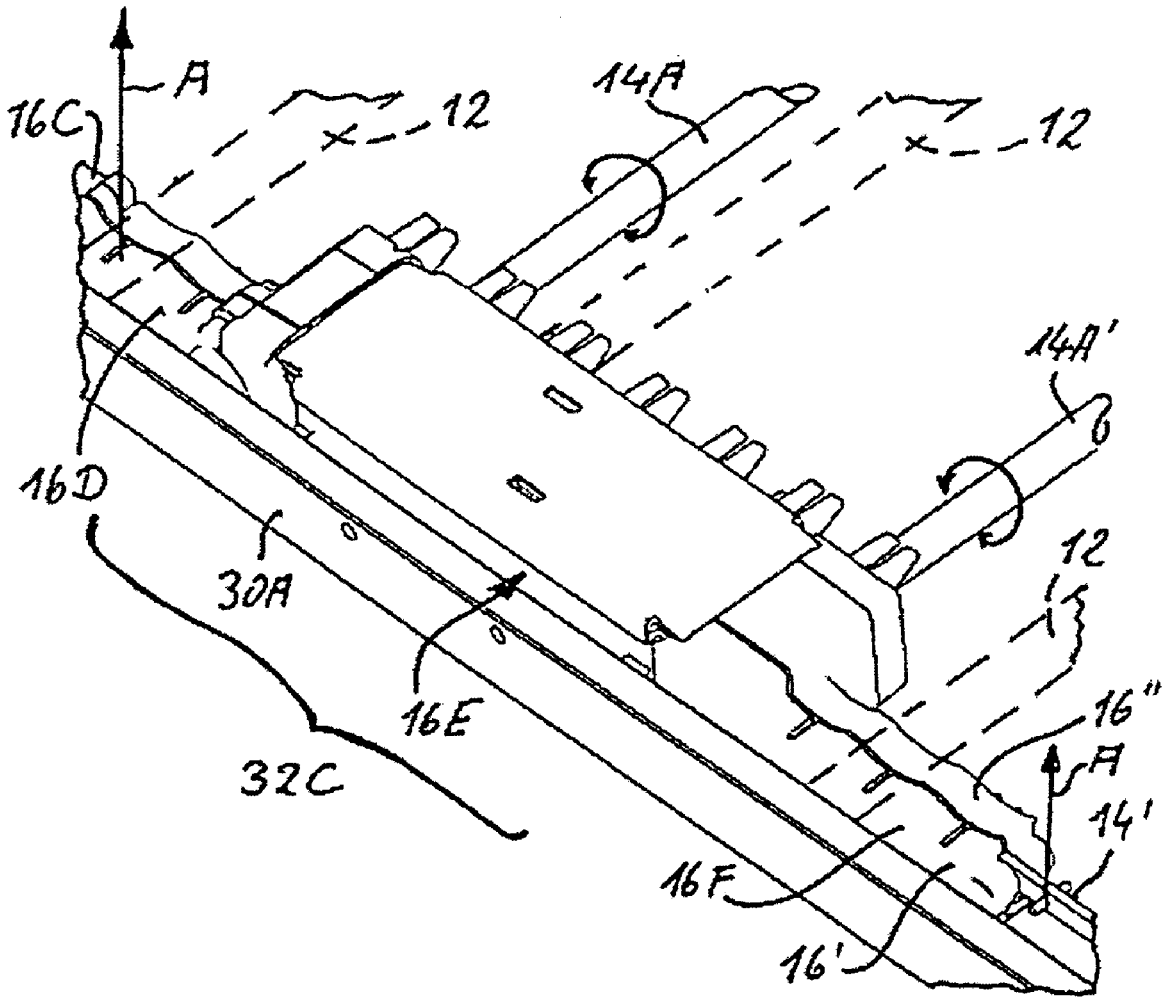
FIG. 7B, a detail enlargement of the same adjustment device in the area of the motor receptacle on one long side.
Figure 8A:
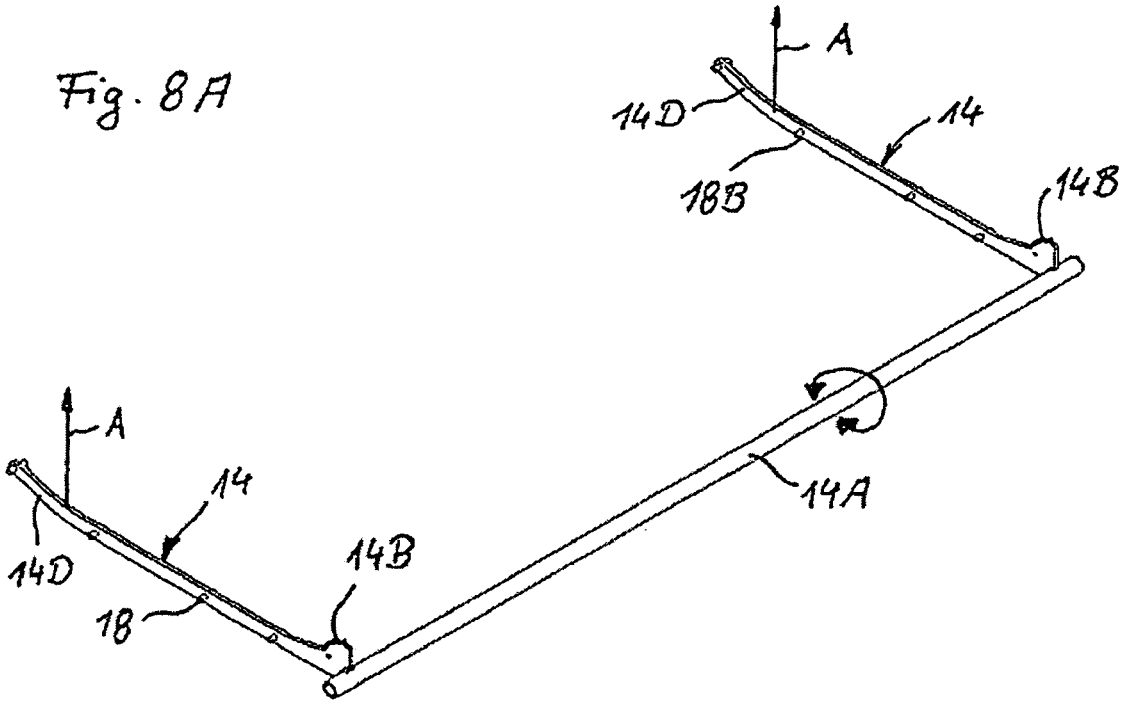
FIG. 8A, a joined adjusting lever pair for the head part of the same adjusting device as in FIGS. 7A/B in a perspective representation.
Figure 8B:
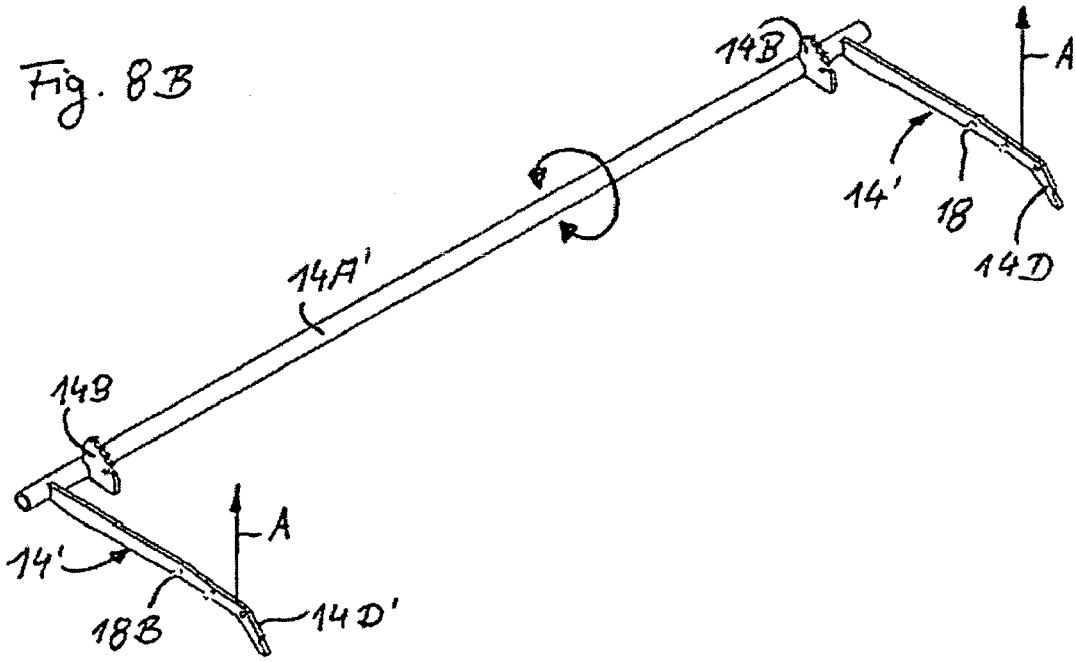
FIG. 8B, a joined adjusting lever pair for the foot part of the same adjusting device as in FIGS. 7A/B in a perspective representation.

As can be deduced from the sequence of FIGS. 3A-3D in conjunction with the perspectival representations of FIGS. 4A and 4B, raising lever 14 for head part 32A of slat grating 32 can be pivoted about the axis of a torsion tube 14A. For the pivot drive in the illustrated embodiment, a quarter-circular tooth segment 14B is provided, at the raising lever end of which one end of a link chain is engaged by way of a bore 14C. The other end of the link chain, not shown in the drawing, but known from German Patent Application No. 102 31 290.7, is pulled by a drive motor that extends in bar member 16E in the area of central part 32C. If desired, torsion tube 14A can be seated at its end areas in corresponding bearings or bores of long beams 30A of rigid bed frame 30 and/or bar member 16E. Tooth segment 14B can fulfill the function of a gusset plate. Rigid raising lever 14 preferably consists of metal or some other comparably inflexible material. As shown in the drawings and, in that sense, preferred, it carries adjusting members 18B in the form of laterally projecting pins which, as will be explained later, have the function of sliding blocks or pads. Raising lever 14 is also distinguished by at least one angled section 14D, so that its profile is not necessarily straight. Preferably, said at least one angled section 14D is oriented in the direction of the general displacement A. This allows, as will be explained, a more-than-proportional upward pivot, especially in the highest head area, without sacrificing the fully integrated position of raising lever 14 inside casing- or box-like bar 16.

With regard to the bar, the adjusting members 18A integrated therein exist as sliding links inside each of the bar parts (inside bar part 16' and outside bar part 16") The sliding links of the inside and outside bar parts 16' and 16" are constructed and arranged mirror-symmetrically and extend on each side of the vertical longitudinal mold joint of bar 16, such that they each slidingly accommodate one of the pins of a respective pair of pins of the adjusting members 18B of the raising lever.

The mode of function of the adjusting device can be deduced in detail in connection with FIGS. 3A-3D described below. From these figures, it is apparent that the sole point of rotation of the raising lever 14, which coincides with the axis of the optional torsion tube 14A, as mentioned above, lies roughly in the lower quarter of box- or casing-like bar 16 at the terminal area of bar member 16E (at the right in the drawing), which defines the rigid center part 32C of slat grating 32. By contrast, pivot joints 22 for pivoting adjacent bar members 16A-16E relative to one another lie essentially at a single height near the upper plane of the bar. This is illustrated particularly clearly in the extended position shown in FIG. 3A. If raising lever 14 is now pivoted up from its horizontal position shown in FIG. 3A into one of the pivot positions shown in FIGS. 3B-3D, a relative longitudinal displacement between the bar members and the raising lever then takes place. By virtue of the fact that a forced guidance is provided between adjusting members 18B of the raising lever and the adjusting members 18A on the bar, the bar members must also pass through transverse displacement with respect to the raising lever in this relative longitudinal displacement if, as shown in the drawings and thus preferred, adjusting members 18A on the bar are designed as sliding links and exhibit an inclination of their curves relative to the longitudinal extent of the individual bar member. Such inclinations are implemented in this embodiment, even with varying inclination profiles along the link. These inclination profiles are adapted to the desired motion or inclination pattern. As is evident from FIG. 3B, uppermost bar member 16A can at first execute only a relative pivot with respect to the other bar members during pivoting upwards of raising lever 14. This is amplified by the degree of inclination of adjusting members 18A on bar members 16B and 16C. This slightly increasing upward inclination from one bar member to the next has the effect that raising lever 14 is positioned at a slight angle inside bar members 16B and 16C in comparison to the rest position (FIG. 3A).

In case of further upward pivoting of raising lever 14 into the position shown in FIG. 3C, however, a relative pivoting between adjacent bar members 16B and 16C increasingly occurs. This takes place in a rotational sense opposed to the upward-directed adjustment direction A of raising lever 14 in order to create a so-called lumbar support. The contrary pivot motion just mentioned is achieved by correspondingly varying inclination profiles of the various adjusting members 18A. This becomes particularly clear in a comparison of FIGS. 3C and 3D.

As is evident from the sequence of FIGS. 3A-3D, pivotable raising lever 14 is furnished with bar members that are separately pivotable, differently from the pivoting motion of the raising lever. It is also evident that the bar members jointly house, substantially completely, an inherently rigid raising lever that serves the mutual adjustment of the bar members. Finally, it is also evident that the bearing or support loads of the pivotable bar are completely absorbed by the inherently rigid raising lever, the raising lever bearing a link chain of members, pivotable relative to one another, that carry bows or spring strips.

FIGS. 3A-4B also reveal that at least one of the pivotable bar members comprises at least one longitudinal and transverse guides and in this regard a sliding link is preferably active between the bar members and the pivotable raising lever. Finally, it is evident that jamming protection means 26 are provided between adjacent pivotable bar members. These jamming protection means are preferably located on the bar side opposite pivot joints 22. They can be constructed, for example, as gap-sealing circular segments, as is evident from the detail enlargement in FIG. 3D. Simple assembly of the spring strips/bows 34, or of their receptacle heads, can be achieved by receptacle cutouts 28. These are preferably cut into the upper casing wall of the bar members, preferably as a slot open on one side in the outside and/or inside bar part, as is evident from FIGS. 4A/4B.

Finally, the sequence according to FIGS. 5A-5D shows another embodiment of casing-like bar members 16F and 16G, which by way of one-piece integrated adjusting members 18A provide longitudinal displaceability with respect to a raising lever 14" and receive the latter's adjusting members 18B slidingly in the form of a pair of sliding blocks. For simplification, a foot brace 20 pivotably mounted on long beam 30A can absorb part of the lever load on the long end of the lever, with a cutout 20E receiving and/or bridging the fulcrum on the long beam in the rest position as in FIG. 5D.

FIGS. 6A-6E show the foot area of an alternative bar 16. Since every individual bar member is longitudinally divided in a vertical plane and is composed in the manner of a casing of inside bar part 16' visible in the drawing and a corresponding outer bar part, FIGS. 6A-6E allow a side view of inside bar part 16'. Also visible is a rigid raising lever 14', which bar 16 receives and almost completely encloses between inside bar part 16' and outside bar part 16".

As can be deduced from the sequence of FIGS. 6A-6E, raising lever 14' for the foot part 32B of slat grating 32 is pivotable about the axis of a torsion tube 14A. A quarter-circular tooth segment, not shown, with which a link chain engages, is provided for the pivot drive. The other end of the link chain known from German Patent Application No. 102 31 290.7 is pulled by a drive motor which extends in bar element 16E in the area of center part 32C. If desired, torsion tube 14A can be seated at its end areas in corresponding bearings or bores of long beams 30A of rigid bed frame 30 and/or bar member 16E. Tooth segment 14B can fulfill the function of a gusset plate. Rigid raising lever 14' preferably consists of metal or some other comparably inflexible material. As shown in the drawings and, in that sense, preferred, it carries adjusting members 18B in the form of laterally projecting pins that, as will be explained below, function as sliding blocks or pads. Raising lever 14' is also distinguished by at least one angled section 14D', so that its profile is not necessarily straight. Preferably, said at least one angled section 14D' is oriented in the direction of the general displacement A. Alongside an overload protection for the knee joint zone of bar 16, it offers, as will be further explained below, a driving function for the extension of the bracing element according to the present invention that is of inventive importance in its own right, independently of the characteristics of claims 1-3.

Despite the fact that, in the illustrated embodiment, the hip part (bar member 16F) carries out a motion to the raising lever by means of a cam arrangement 18A/18B during pivoting of raising lever 14' and, that moreover, a buckling-compensation element 40 is inserted between bar members 16F and 16G, the outermost member of foot part 32B (bar member 16G) has a pivot joint 22 in the upper bar area at its area closest to adjacent bar member 16F. This pivot joint 22 is formed in part by a pair of cams 36 of raising lever 14' by virtue of the fact that these cams engage rotatably in corresponding recesses of bar member 16G. This arrangement has the effect that articulation point 22, 36 is raised in the pivoting upwards of raising lever 14'. Because of the rotationally movable seating of pins 36 and the weight of the lower leg part, that is, that of the two parallel bar members 16G, the support elements 12 connecting them and a mattress possibly lying thereon, the outermost end (at the right in the drawing) of bar member 16G is always allowed to remain on its stationary base, such as long beam 30A. Under certain circumstances, however, there is a shift in the direction D along the support plane, such as long beam 30A.

In order to achieve a certain raising of bar member 16G as a whole in the upward pivoting of raising lever 14', an extensible support member 20 in the form of a foot rest is provided. In the illustrated and thus preferred embodiment, the extensible bracing element is a knee lever with two legs 20A and 20B at a fixed angle to one another, which is seated with the ability to pivot about a shared pivot axis 20D in the knee area at the end and in the lower area of bar member 16G.

While bracing element 20 as a whole is housed in bar 16 in the extended position of the foot part according to FIG. 2A, a pivoting about knee joint 20C causes an excursion of leg 20A downwards, so that bar member 16G raises the right end of bar member 16F in the drawing while the free end of leg 20A is braced against a base, such as long beam 30A. This raising is accomplished by active driving of leg 20A.

For this purpose, a rocker 50 is provided, with which angled section 14D' of raising lever 14' at one end and, at the other end, the free end of leg 20B of bracing element 20 are pivotably engaged. Rocker 50 is rotatably seated inside bar member 16F about pin 50C of rocker 50, In the illustrated embodiment, this rocker 50 consists of a straight, extended metal rod made of flat material with elongated holes 50A and 50B at each end. Pivot pins 14E of raising lever 14 and 20D of bracing element 20 are in turn engaged in these elongated holes. When raising lever 14' is raised and angled section 14D' accordingly carries out a pivoting motion with respect to bar member 16G about rotational joint 22, 36, rocker 50 is pivoted inside bar member 16F about its pivot pin 50C. This rocker movement, which is evident from the sequence of FIGS. 6A-6E, leads to a forced pivoting of bracing element 20, which is coupled to rocker 50, and thus to a driven excursion of the bracing element out of bar member 16G. When raising lever 14' is lowered, bracing element 20 moves forcibly back into bar member 16G.

Any coupling of the bracing element to another component is thereby superfluous. Instead, a foot lever drive is created and integrated into bars 16. It is also not dependent on a permanent contact with a foundation or a base surface, but goes into action independently thereof. It is therefore possible, among other things, to move the foot part even beyond the maximal raising position illustrated in FIG. 6E, also by hand, for instance. It is also possible to carry out the excursion motion and/or to make the contact of bracing element 20 against a base only in a certain angular position or angular range of raising lever 14'.

A bar member chain can include only of one bar member for the head piece, one bar member for the middle part and one bar member for the foot part.

In an additional embodiment according to FIGS. 7A-8B, the same reference numbers are again used for identically acting components. This additional embodiment, which can also very favorably be employed in the context of the preceding embodiments, is distinguished in that rigid bar member 16E of middle part 32C comprises two electric motors 60A and 60B that are housed parallel to one another in bar member 16E and of which the output shafts 62A, 62B extend roughly parallel to bar member 16E. The outer electric motors 60A via, for example, an output, spindle a linearly guided carriage 63A, which entrains a link chain 64A acting on a tooth segment 14B, as is presented in detail in German Patent Application No. 102 31 290.7 of Jul. 10, 2002, and represented by double-headed arrows in FIG. 7A or in FIGS. 8A and 8B. The quarter-circular tooth segments 14B preferably used for this, which are rigidly joined to the torsion tube 14A or 14A', are arranged in the plane of the two raising levers 14 for the head part and are offset from the two raising levers 14' in the foot part, so that the moved bar members extend in a single vertical plane.

Of course, a synchronization of the pairwise-associated electric motors 60A and 60B in the facing bars is also possible by electrical or electronic means, but a forced coupling due to the connection to torsion tubes has proved to be particularly simple and effective.

The invention claimed is:

1. An adjusting device for beds, mattresses, armchairs and the like, comprising support elements extending at an angle to the adjusting direction on both sides, and jointly spanning a support plane, and at least one drive device for modifying the inclination of the support plane with at least one pivotable raising lever, wherein said at least one pivotable raising lever is provided with several bar members, separately pivotable differently from the pivotable raising lever.

2. The adjusting device according to claim 1 wherein the bar members form a link chain.

3. The adjusting device according to claim 1, wherein the bar members are longitudinally and transversely displaceable relative to and by the pivotable raising lever.

4. The adjusting device according to claim 1, wherein at least one of the bar members comprises at least one longitudinal and transverse guide.

5. The adjusting device according to claim 1, wherein the bar members are pivotable in differing rotational senses relative to one another by use of the pivoting of the pivotable raising lever.

6. The adjusting device according to claim 1, wherein, in order to pivot at least one of the bar member(s), a sliding link operative between the latter and the pivotable raising lever is provided.

7. The adjusting device according to claim 1, wherein at least one of the bar members is an integral component of a device for differing pivoting of the bar members relative to raising the lever.

8. The adjusting device according to claim 1, wherein the bar members constitute a casing.

9. The adjusting device according to claim 1, wherein the bar members are divided in two.

10. The adjusting device according to claim 1, wherein the pivotable raising lever is disposed inside bar members.

11. The adjusting device according to claim 1, wherein the pivotable raising lever is constructed as a cantilever and is pivotably seated on a middle or base part of the adjusting device.

12. The adjusting device according to claim 1, wherein the device further comprises a jamming protection assembly disposed between at least two adjacent bar members.

13. An adjusting device for beds, mattresses, armchairs and the like, comprising bar members extending at an angle to the adjusting direction on both sides, jointly spanning a support plane, with at least one drive device for modifying the inclination of the support plane, in which the bar members form a link chain, wherein the bar members jointly house, an inherently rigid, pivotable raising lever serving for mutual adjustment of the bar members.

14. The adjusting device according to claim 13, wherein the pivotable bar members form a link chain.

15. The adjusting device according to claim 13, wherein the bar members are longitudinally and transversely displaceable relative to and by the pivotable raising lever.

16. The adjusting device according to claim 13, wherein at least one of the bar members comprises at least one longitudinal and transverse guide.

17. The adjusting device according to claim 13, wherein the bar members are pivotable in differing rotational senses relative to one another by use of the pivoting of the pivotable raising lever.

18. The adjusting device according to claim 13, wherein in order to pivot at least one of the bar member(s), a sliding link operative between the latter and the pivotable raising lever is provided.

19. The adjusting device according to claim 13, wherein at least one of the bar members is an integral component of a device for differing pivoting of the bar members relative to the raising lever.

20. The adjusting device according to claim 13, wherein the bar members constitute a casing.

21. The adjusting device according to claim 13, wherein the bar members are divided in two.

22. The adjusting device according to claim 13, wherein the pivotable raising lever is guided inside bar members.

23. The adjusting device according to claim 13, wherein the raising lever is constructed as a cantilever and is pivotably seated on a middle or base part of the adjusting device.

24. The adjusting device according to claim 13, wherein the device further comprises a jamming protection means provided between at least two adjacent bar members.

25. The adjusting device for beds, mattresses, armchairs or the like, according to claim 13 further comprising a plurality of drive devices for modifying the inclination of the support plane, in which the bar members form a head part, a foot part and a middle part, each of two bar members defining the middle part houses a pair of electric motors with output shafts extending essentially parallel to adjacent bar members and arranged in a plane extending essentially through the bar members.

26. The adjusting device according to claim 25, wherein bar members housing the two electric motors include casings exceeding the width of the rest of the bar.

27. The adjusting device according to claim 25, wherein the two electric motors of the bar members on opposite sides are engaged by synchronization, torsion tubes.

28. The adjusting device according to claim 25, wherein the pivoting raising levers of bar members are arranged parallel and offset to the output shafts of electric motors.

29. The adjusting device according to claim 25, wherein two raising levers associated with the bars of the head part or the foot part are jointly pivotable by use of a torsion tube and are each connected at their terminal areas on the torsion tube side to drive transfer components for electric motors to provide a pivot drive.

30. The adjusting device according to claim 13 wherein one of the bar members comprises a driven extensible bracing element for bracing the bar member against a base surface.

31. The adjusting device according to claim 30, wherein the bar member comprising the bracing element comprises a rocker that transmits a drive force for extension/retraction motion.

32. The adjusting device according to claim 31, wherein the rocker is arranged inside bar members comprising the bracing element.

33. The adjusting device according to claim 30, further comprising a driven raising lever that raises and/or lowers one end of the bar member comprising the bracing element.

34. The adjusting device according to claim 33, wherein the raising lever forcibly pivots the rocker during the pivoting of the raising lever.

35. The adjusting device according to claim 30, wherein the extensible bracing element is constructed as a knee lever with rigid legs, the knee lever being pivotably seated relative to bar member housing it about a knee lever joint.

36. An adjustable support device for mattresses, or cushions, beds, armchairs and the like, comprising pivotable bars with support elements extending between the bars, spanning a support plane, wherein the pivotable bars are each formed of at least one inherently rigid raising lever which carries a link chain of support element bearing members pivotable relative to one another.

37. The adjusting device according to claim 36, wherein the pivotable bar members are longitudinally and transversely displaceable relative to and by the raising lever.

38. The adjusting device according to claim 36, wherein at least one of the pivotable bar members comprises at least one longitudinal and transverse guide.

39. The adjusting device according to claim 36, wherein the bar members are pivotable in differing rotational senses relative to one another by use of the raising lever.

40. The adjusting device according to claim 36, wherein, in order to pivot at least one of the bar member(s), a sliding link operative between the latter and the pivotable raising lever is provided.

41. The adjusting device according to claim 36, wherein at least one of the bar members is an integral component of a device for differing pivoting of the bar members relative to the raising lever.

42. The adjusting device according to claim 36, wherein the pivotable bar members constitute a casing.

43. The adjusting device according to claim 36, wherein the pivotable bar members are divided in two.

44. The adjusting device according to claim 36, wherein the raising lever is guided inside bar members.

45. The adjusting device according to claim 36, wherein the raising lever is constructed as a cantilever and is pivotably seated on a middle or base part of the adjusting device.

46. The adjusting device according to claim 36, wherein the device further comprises a jamming protection assembly provided between at least two adjacent bar members.

* * * * *